US009557687B2

(12) United States Patent
Suzuki

(10) Patent No.: US 9,557,687 B2
(45) Date of Patent: Jan. 31, 2017

(54) LIQUID SUPPLY DEVICE, DEVELOPING DEVICE, AND IMAGE FORMING APPARATUS

(71) Applicant: FUJI XEROX CO., LTD., Tokyo (JP)

(72) Inventor: Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 4 days.

(21) Appl. No.: 14/836,488

(22) Filed: Aug. 26, 2015

(65) Prior Publication Data

US 2016/0259272 A1 Sep. 8, 2016

(30) Foreign Application Priority Data

Mar. 4, 2015 (JP) ..... 2015-042822

(51) Int. Cl.

| | |
|---|---|
| ***G03G 15/00*** | (2006.01) |
| ***G03G 15/11*** | (2006.01) |
| ***G03G 15/10*** | (2006.01) |
| *G03G 15/08* | (2006.01) |

(52) U.S. Cl.

CPC ..... *G03G 15/11* (2013.01); *G03G 15/10* (2013.01); *G03G 15/0812* (2013.01)

(58) Field of Classification Search

CPC G03G 15/11; G03G 15/0818; G03G 15/0121; G03G 15/0812; G03G 15/0877; G03G 15/10; G03G 15/104

USPC ..... 399/119, 237–239, 249

See application file for complete search history.

(56) References Cited

U.S. PATENT DOCUMENTS

| | | | | |
|---|---|---|---|---|
| 6,337,963 | B1 * | 1/2002 | Kusayanagi | G03G 15/101 399/237 |
| 2004/0057754 | A1 | 3/2004 | Shibata et al. | |
| 2006/0150836 | A1 | 7/2006 | Berg et al. | |
| 2006/0232615 | A1 | 10/2006 | Berg et al. | |
| 2007/0212113 | A1 * | 9/2007 | Berg | B41F 31/027 399/238 |
| 2007/0280737 | A1 * | 12/2007 | Berg | G03G 9/12 399/240 |
| 2008/0279597 | A1 * | 11/2008 | Berg | G03G 15/104 399/279 |

FOREIGN PATENT DOCUMENTS

| | | | |
|---|---|---|---|
| JP | 2007534976 | A | 11/2007 |
| JP | 2011175212 | A | 8/2011 |
| JP | 2003066729 | A | 3/2015 |

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A liquid supply device includes a reservoir that stores a liquid developer, a rotating supply member that holds a portion of the liquid developer in the reservoir in concave sections formed in a surface, and supplies the liquid developer to a target supply member, and a regulating member having an edge portion which is positioned on a lower side in a gravitational direction than a liquid surface of the liquid developer stored in the reservoir, and a lower surface of the regulating member contacts with the liquid developer in the reservoir, the regulating member regulating an amount of a liquid developer held on a surface of the rotating supply member by contacting with the rotating supply member at a position where a surface of the rotating supply member moves from a lower side to an upper side in the gravitational direction.

9 Claims, 5 Drawing Sheets

LIQUID SUPPLY DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2015-042822 filed Mar. 4, 2015.

BACKGROUND

Technical Field

The present invention relates to a liquid supply device, a developing device, and an linage forming apparatus.

SUMMARY

According to an aspect of the invention, there is provided a liquid supply device including:

a reservoir that stores a liquid developer;

a rotating supply member that holds a portion of the liquid developer in the reservoir in concave sections formed in a surface, and supplies the liquid developer to a target supply member; and a regulating member having an edge portion which is positioned on a lower side in a gravitational direction than a liquid surface of the liquid developer stored in the reservoir, and a lower surface of the regulating member contacts with the liquid developer in the reservoir, the regulating member regulating an amount of a liquid developer held on a surface of the rotating supply member by contacting with the rotating supply member at a position where a surface of the rotating supply member moves from a lower side to an upper side in the gravitational direction.

BRIEF DESCRIPTION OF THE DRAWINGS

Exemplary embodiments of the present invention will be described in detail based on the following figures, wherein.

DETAILED DESCRIPTION (First Exemplary Embodiment)

Examples of a liquid supply device, a developing device and an image forming apparatus according to a first exemplary embodiment will be described.

Overall Configuration

Figure 1:
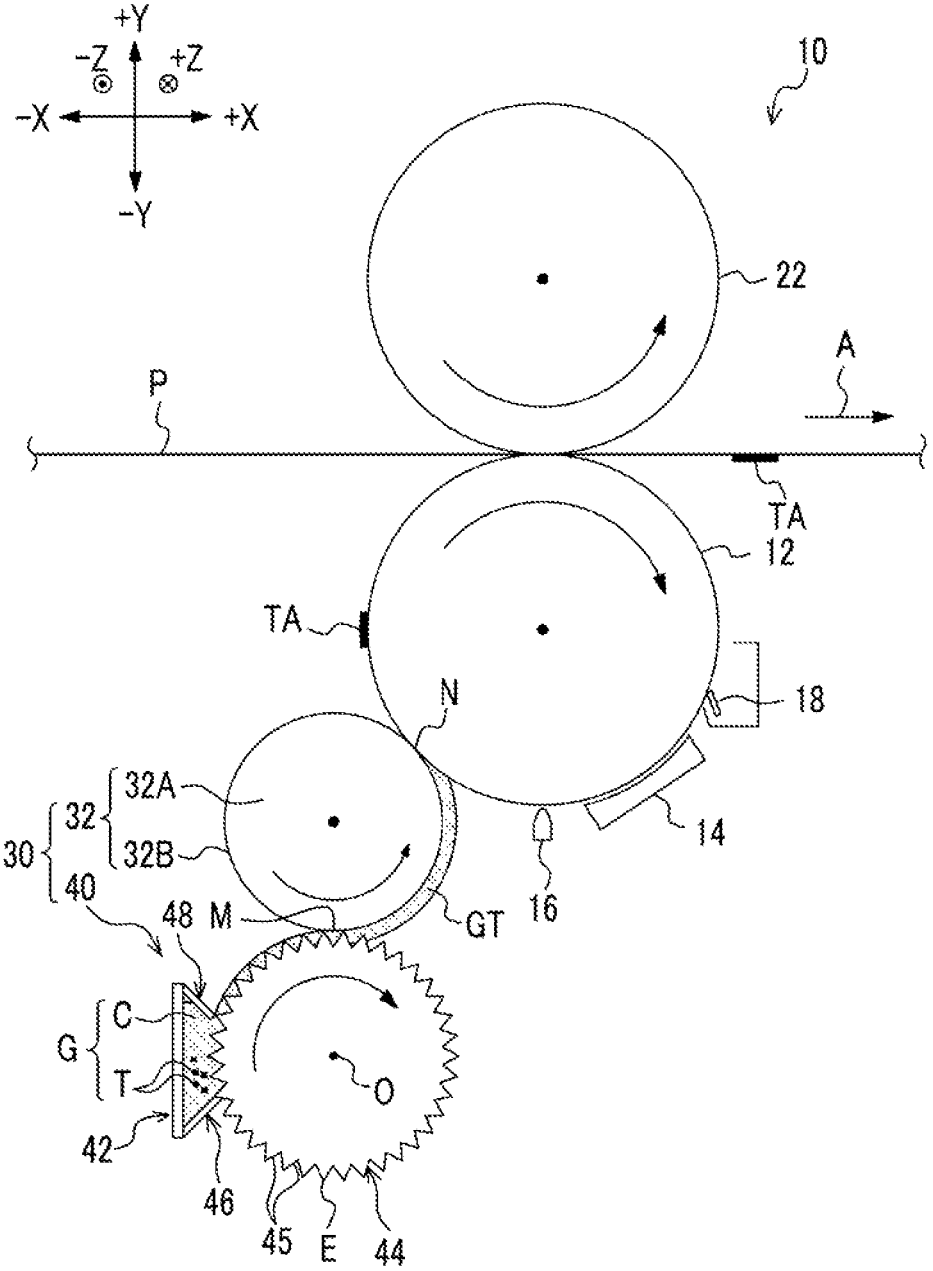
FIG. 1 is an overall configuration diagram of an image forming apparatus according to a first exemplary embodiment.

FIG. 1 shows an image forming apparatus 10 according to the first exemplary embodiment. In the following description, a direction that is shown by an arrow Y in FIG. 1 will be referred to as a device height direction, and a direction that is shown by an arrow X in FIG. 1 will be referred to as a device width direction. In addition, a direction (shown by Z) that is respectively orthogonal to the device height direction and the device width direction will be referred to as a device depth direction. Further, when the image forming apparatus 10 is viewed from a side (viewed from the front) on which a user (not illustrated) stands, the device width direction, the device height direction and the device depth direction will be referred to as an X direction, a x direction and a Z direction. The Y direction is an example or a gravitational direction.

Furthermore, in a case in which it is necessary to discriminate between one side and the other side of the X direction, the Y direction and the Z direction, when the image forming apparatus 10 is viewed from the front, an upper side will be referred to as a +Y side, a lower side will be referred to as a −Y side, a right side will be referred to as a +X side, a left side will be referred to as a −X side, a deep side will be referred to as a +Z side, and a front side will be referred to as a −Z side.

The image forming apparatus 10 is configured to include a photosensitive member 12 as an example of an image holding member, a charging device 14, an exposure device 16, a developing device 30, a transfer roller 22 as an example of a transfer unit, a cleaning blade 18, and a fixing unit (not illustrated). In addition, the image forming apparatus 10 includes a transport roller (not illustrated) that transports sheets of paper P, as an example of a target transfer member, in a direction that is shown by an arrow A. Furthermore, in the image forming apparatus 10, image formation is performed using a liquid developer G, and the fixing unit fixes toner images TA, as an example of developer images on sheets of paper P, to sheets of paper P by heating and pressurizing the toner images TA.

Liquid Developer

As one example, the liquid developer G has a configuration in which toner T is dispersed in a carrier liquid C, and a solid component concentration thereof is set as 25 (% by weight). An insulating liquid such as vegetable oil, liquid paraffin oil, silicone oil, or the like is used as the carrier liquid C, and in the exemplary embodiment, as an example, silicone oil is used. In addition, as an example, toner particles in which a polyester resin, which is a thermoplastic resin, is set as the main ingredient of a binding resin, are used in the toner T.

Furthermore, as an example, after being thermally managed inside a heat exchanger-equipped storage tank (not illustrated) that is provided separately to the developing device 30, the liquid developer G is supplied to the developing device 30. Additionally, a lower limit temperature in the thermal management of the liquid developer G is determined based on a temperature at which the liquid developer G does not form condensation inside the linage forming apparatus 10. In addition, an upper limit temperature in the thermal management of the liquid developer G is determined so as to be less than the glass transition temperature of the toner T, Photosensitive Member As an example, the photosensitive member 12 includes a substrate, which is a cylindrical shape and is grounded, and a photosensitive layer (not illustrated) that is formed at the outer peripheral surface of the substrate, and holds a latent image at the outer peripheral surface thereof. In addition, the photosensitive member 12 is supported so as to be capable of rotating with the Z direction as an axial direction thereof, by a frame (not illustrated), which is provided inside the image forming apparatus 10. The charging device 14, which charges the outer peripheral surface of the photosensitive member 12, the exposure device 16, which forms a latent image by exposing the outer peripheral surface of the photosensitive member 12, the developing device 30, which will be described later, and the cleaning blade 18, which cleans the outer peripheral surfaces of the transfer roller 22 and the photosensitive member 12, are disposed in the vicinity of the photosensitive member 12.

Transfer Roller

The transfer roller 22 is provided on a downstream of the developing device 30 in a rotational direction of the photosensitive member 12, and on an upstream of the cleaning blade 18 with the Z direction as an axial direction thereof. In addition, the transfer roller 22 and the photosensitive member 12 interpose sheets of paper P therebetween. Furthermore, a difference in potential, which causes toner images TA held on the outer peripheral surface of the photosensitive member 12 to be transferred to sheets of paper P after developing, which will be described later, is generated between the transfer roller 22 and the photosensitive member 12. As a result of this, toner images TA of the photosensitive member 12 are transferred to sheets of paper P at a transfer position, which is interposed between the photosensitive member 12 and the transfer roller 22.

Developing Device

As shown in FIG. 1, the developing device 30 is provided on the downstream of the exposure device 16 in the rotational direction of the photosensitive member 12, and on the upstream of the transfer roller 22. In addition, the developing device 30 includes a developing roller 32, as one example of a developing rotating member and a target supply member, and a supply device 40 as an example of a liquid supply device that supplies the liquid developer G to the developing roller 32.

Developing Roller

The developing roller 32 has a configuration in which an elastic layer 32B is provided on the outer peripheral surface of a metallic columnar core roller 32A. The core roller 32A is supported so as to be capable of rotating with the 2 direction as the axial direction thereof, by the frame (not illustrated), which is provided inside the image forming apparatus 10. In addition, a bias voltage is applied to the core roller 32A from a power source (not illustrated). Additionally, the length of the core roller 32A in the axial direction of the developing roller 32 is longer than the length of the elastic layer 328.

In addition, the elastic layer 32B of the developing roller 32 contacts with the outer peripheral surface of a supply roller 44, which will, be described later. Further, a developer layer GT of the liquid developer G is formed on the developing roller 32 at a contact section M between the developing roller 32 and the supply roller 44. Furthermore, the elastic layer 32B of the developing roller 32 forms a developing nip section N by contacting with the photosensitive member 12.

In this manner, the developing roller 32 forms toner images TA on the outer peripheral surface of the photosensitive member 12 by holding the liquid developer G supplied from the supply roller 44 on the outer peripheral surface thereof, and developing (visualizing) latent images of the photosensitive member 12 using the liquid developer G (the developer layer GT). Additionally, the supply roller 44 and the developing roller 32 move in the same direction at the contact section M, and the developing roller 32 and the photosensitive member 12 move in the same direction at the developing nip section N.

Main Section Configuration

Next, the supply device 40 will be described.

Figure 2:
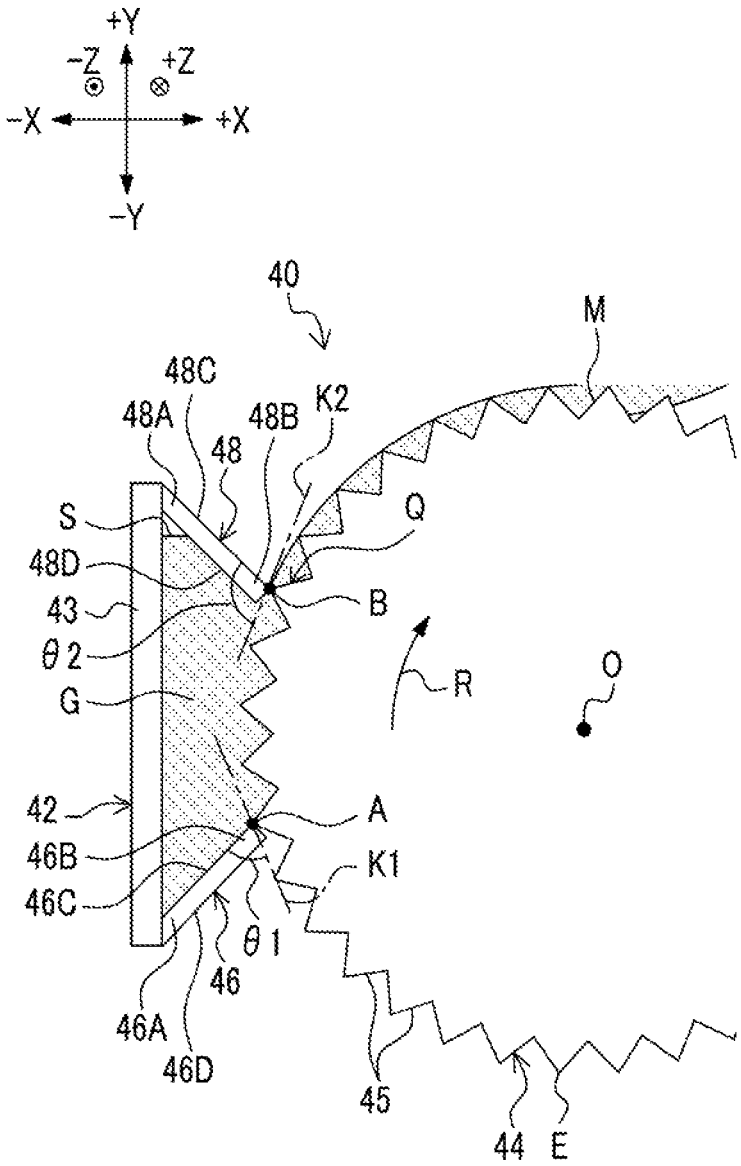
FIG. 2 is an explanatory diagram in which a portion of a supply device according to the first exemplary embodiment has been enlarged.

As shown in FIG. 2, the supply device 40 includes a chamber 42, which stores the liquid developer G, and the supply roller 44, as an example of a supply member.

Supply Roller

The supply roller 44 is an anilox roller that holds a portion of the liquid developer G of the chamber 42 and supplies the liquid developer G to the contact section M of the developing roller 32. More specifically, as an example, the supply roller 44 is formed in a cylindrical shape by carrying out laser engraving on a ceramic coating layer formed by performing a plasma spraying treatment on a metallic roller peripheral surface. As an example, the diameter of the supply roller 44 is set as 120 mm.

In addition, the supply roller 44 is supported so as to be capable of rotating with the Z direction as the axial direction thereof, by a housing (not illustrated) of the image forming apparatus 10 (refer to FIG. 1). In the following description, a rotational direction of the supply roller 44 will be referred to as an R direction. In addition, a position of a rotational center of the supply roller 44 will be referred to as a rotational center O.

Cells 45, as an example of concave sections, multiple numbers of which are arranged in a peripheral direction, and which are open on a diameter direction outer side of the supply roller 44, are formed at the outer peripheral surface of the supply roller 44. The volume of the ceils 45 is set as a size at which it is possible to hold the liquid developer G, and at which it is difficult for arrangement patterns of the cells 45 to appear in the toner images TA (refer to FIG. 1), and as an example, is set as approximately 12 ml (milliliters)/$m^2$. Additionally, in FIG. 2, multiple cells 45 at an outer peripheral section of the supply roller 44 are shown in triangular shape when the supply roller 44 is viewed macroscopically in the Z direction, but when viewed microscopically, there is a curved surface that forms the outer peripheral surface of the supply roller 44 between adjacent cells 45.

Chamber

The chamber 42 includes a reservoir member 43, as an example of a reservoir section that stores the liquid, developer G, a seal blade 46, and a doctor blade 48, as an example of a regulating member. Additionally, in FIGS. 1 and 2, the reservoir member 41 is shown simplified as a rectangular shape when the chamber 42 is viewed in the Z direction.

Reservoir Member

As an example, the reservoir member 43 is formed in a box shape that is long in the Z direction, and open on the +X side. In addition, the reservoir member 43 is disposed on the −X side of the supply roller 44 in a state in which an open side thereof faces the outer peripheral surface of the supply roller 44. More specifically, as an example, a position of the center of the reservoir member 43 in the Y direction is disposed so as to be substantially the same height as a position of the rotational center O of the supply roller 44.

Furthermore, the reservoir member 43 is disposed so as to face a site (referred to as a movement site Q) on the outer peripheral surface of the supply roller 44 that moves toward an upper side (the +Y side) in the Y direction from a lower side (the −Y side). Additionally, in the exemplary embodiment, on the outer peripheral surface of the supply roller 44 that is shown in FIG. 2, the movement site Q of the outer peripheral surface of the supply roller 44 refers to a portion of a range along the R direction from a lower end section E, which is a −Y side end section, to the contact section M.

A supply pipe (not illustrated), which supplies the liquid developer G to the inside of the reservoir member 43, is connected to a lower end section (a −Y side end section) of the reservoir member 43. In addition, a discharge pipe (not illustrated), which discharges the liquid developer G that becomes surplus inside the reservoir member 43, is connected to an upper end section (a +Y side end section) of the reservoir member 43.

In this instance, the liquid developer G flows into the inside of the reservoir member 43 as a result of the liquid developer G being fed from the storage tank (not illustrated) into the inside of the supply pipe using a pump, and the liquid developer G is stored inside the chamber 42. The liquid developer G that becomes surplus inside the reservoir member 43 is recovered by a recovery tank (not illustrated) through the discharge pipe. Additionally, a feed-in amount of the liquid developer G to the supply pipe is set to be larger than or equal to a supply amount of the liquid developer G to the supply roller 44. As a result of this, a liquid surface S of the liquid developer G inside the reservoir member 43 is retained in a state of being positioned further on a +Y side than an edge portion 48B of the doctor blade 48, which will be described later.

Seal Blade

As an example, the seal blade 46 is made from stainless steel, and is formed in a plate shape in which the Z direction is set as a long direction with a thickness of 0.2 mm. In addition, the length in the Z direction of the seal blade 46 is substantially the same length as the length in the Z direction of the outer peripheral surface of the supply roller 44. Furthermore, in the seal blade 46, a base end section 46A of the −X side in a short direction is attached to the −Y side end section of the reservoir member 43, and an edge portion 46B of the +X side in the short direction contacts with the outer peripheral surface of the supply roller 44. As an example, a step-providing treatment is carried out on the edge portion 46B.

A surface of the +Y side of the seal blade 46 is set as an upper surface 46C, and a surface of a −Y side thereof is set as a lower surface 46D. The lower surface 46D does not contact with the liquid developer G. Meanwhile, substantially the entirety of the upper surface 46C contacts with the liquid developer G. In other words, the seal blade 46 forms a bottom wall of the chamber 42.

In addition, the seal blade 46 is disposed inclined along a direction that intersects the Y direction when viewed from the Z direction (at art X-Y plane), and the edge portion 46B is disposed on a +X side and a +Y side with respect to the base end section 46A. In this instance, a contact position on the X-Y plane between the edge portion 46B and the outer peripheral surface of the supply roller 44 is referred to as a point A. In addition, as a result of the outer peripheral surface of the supply roller 44 resembling a circle, a tangential line of the supply roller 44 at the point A is set as a tangent K1, Among angles that are formed by the tangent K1 and the upper surface 46C, as an example, the seal blade 46 is disposed inclined so that an angle θ1 of an upstream side in the R direction is 60°. Additionally, as an example, the point A is positioned further on the −Y side than the rotational center O.

Doctor Blade

As an example, the doctor blade 48 is made from stainless steel, and is formed in a plate shape in which the Z direction is set as a long direction with a thickness of 0.2 mm. In addition, the length in the Z direction of the doctor blade 48 is substantially the same length as the length in the Z direction of the outer peripheral surface of the supply roller 44. Furthermore, in the doctor blade 48, a base end section 48A of the −X side in a short direction is attached to the +Y side end section of the reservoir member 43, and the edge portion 48B of the +X side in the short direction contacts with the outer peripheral surface of the supply roller 44. As an example, a step-providing treatment is carried out on the edge portion 48B.

A surface of the +Y side of the doctor blade 48 is set as an upper surface 48C, and a surface of a −Y side thereof is set as a lower surface 48D. The upper surface 48C does not contact with the liquid developer G. Meanwhile, apart from a portion of a base end section 48A side, the lower surface 48D contacts with the liquid developer G. In other words, the doctor blade 48 forms a portion of an upper wall of the chamber 42, and contacts with the liquid developer G.

In addition, the doctor blade 48 is disposed inclined along a direction that intersects the Y direction when viewed from the Z direction, (at the X-Y plane), and the edge portion 48B is disposed on a +X side and a −Y side with respect to the base end section 48A. Furthermore, a contact position on the X-Y plane between the edge portion 48B and the outer peripheral surface of the supply roller 44 is referred to as a point B. In addition, as a result of the outer peripheral surface of the supply roller 44 resembling a circle, a tangential line of the supply roller 44 at the point B is set as a tangent K2. Among angles that are formed by the tangent K2 and the upper surface 48C, as an example, the doctor blade 48 is disposed inclined so that an angle θ2 of an upstream side in the R direction is 120°. Additionally, as an example, the point B is positioned further on the +Y side than the rotational center O.

In this instance, the position in the Y direction of a liquid surface S of the liquid developer G that is stored inside the chamber 42 is further on the +Y side than, the edge portion 48B of the doctor blade 48, and is further on the −Y side than the base end section 48A as a result of the supply amount of the liquid developer G being managed by the pump (not illustrated) mentioned above. As an example, the position in the Y direction of the liquid surface S is regulated so as to be 5 mm above the point B in the Y direction.

In this manner, in the doctor blade 48, the edge portion 48B is disposed on a lower side in the Y direction than the liquid surface S, and the lower surface 48D contacts with the liquid developer G. In addition, the doctor blade 48 regulates a holding amount of the liquid developer G of the outer peripheral surface of the supply roller 44 as a result of the edge potion 48B contacting with the movement site Q of the outer peripheral surface of the supply roller 44. Additionally, the regulating of the holding amount refers to decreasing a surplus amount, among the liquid developer G held on the outer peripheral surface of the supply roller 44, to a required amount of liquid developer G at the contact section M by scraping the liquid developer G off with using the doctor blade 48.

Comparative Example

A supply device (not illustrated) in which the edge portion 48B of the doctor blade 48 is disposed on the +X side and the +Y side with respect to the base end section 48A, and in which the liquid developer G does not contact with a lower surface of the doctor blade 48 is set as a comparative example. In the supply device of the comparative example, the edge portion 48B of the doctor blade 48 which contacts with the outer peripheral surface of the supply roller 44, emits heat due to friction that follows rotation of the supply roller 44. Further, if the temperature of the edge portion 48B of the doctor blade 48 rises, since resin particles of the toner T, which is a portion of the liquid developer G, melt or become softened, there is a potential for the resin particles of the toner T to become adhered to inner surfaces of the multiple cells 45 of the supply roller 44.

In addition, in the supply device of the comparative example, since the resin particles of the toner T become adhered to the inner surfaces of the cells 45, the volume of the cells 45 is reduced in comparison with a case in which the resin particles do not become adhered thereto. As a result of this, there is a potential for the supply amount of the liquid developer G that is supplied from the supply roller 44 to the developing roller 32 to be decreased.

Mechanisms

Next, the mechanisms of the first exemplary embodiment will be described.

In the supply device 40 that is shown in FIG. 2, when the supply roller 44 rotates in the R direction, the edge portion 46B of the seal blade 46 emits heat due to friction between the seal blade 46 and the supply roller 44. In this instance, since the upper surface 46C of the seal blade 46 and the liquid developer G contact with one another, and the entire seal blade 46 is cooled by the liquid developer G, rises in temperature of the edge portion 46B are suppressed. As a result of this, a circumstance in which the temperature of the edge portion 46B rises, a portion of the toner T in the liquid developer G melts or becomes softened, and becomes adhered to the cells 45 is suppressed.

Furthermore, in the supply device 40, when the supply roller 44 rotates in the R direction, the edge portion 48B of the doctor blade 48 emits heat due to friction between the doctor blade 48 and the supply roller 44.

In this instance, in the supply device 40, a contact area between the lower surface 48D of the doctor blade 48 and the liquid developer G is larger than that of the supply device of the comparative example mentioned above. That is, in the supply device 40, since a cooling range of the doctor blade 48 is wider than that of the supply device of the comparative example, rises in temperature of the edge portion 46B are suppressed. As a result of this, a circumstance in which the temperature of the edge portion 48B rises, a portion of the toner T in the liquid developer G melts or becomes softened, and becomes adhered to the cells 45 is suppressed, In addition, in the supply device 40, the doctor blade 48 contacts with the movement site Q on the outer peripheral surface of the supply roller 44, which moves toward the side in the Y direction from the −Y side, as a result of rotation. As a result of this, since the liquid developer G after the holding amount has been regulated, is transported in a state of being held at a site that is on the +Y side of the supply roller 44, it is difficult for the liquid developer G to fail from the supply roller 44, and therefore, in comparison with the supply device of the comparative example, it is unlikely that the inside of the supply device 40 will become stained by the liquid developer G. Furthermore, the installation of equipment such as charging units and surface potential gauges in positions that face the outer peripheral surface of the supply roller 44 after passing through the doctor blade 48 is made easier by the fact that if is difficult for the liquid developer G to fall from the outer peripheral surface of the supply roller 44 after passing through the doctor blade 48.

In the developing device 30 that is shown in FIG. 1, a circumstance in which a portion of the toner T melts or becomes softened and becomes adhered to the cells 45 is suppressed, and therefore, a circumstance in which the holding amount of the liquid developer G that is held on the outer peripheral surface of the supply roller 44 is partially reduced, is suppressed. Therefore, in the developing device 30, a circumstance in which the supply amount of the liquid developer G, which is supplied from the supply roller 44 to the developing roller 32, is reduced, is suppressed in comparison with a configuration that includes the supply device of the comparative example mentioned above. As a result of this, in the developing device 30, developing defects (for example, insufficient amounts of the toner T being transferred to the photosensitive member 12) that are caused by a portion of the liquid developer G becoming adhered to the supply roller 44, are suppressed.

In the image forming apparatus 10 that is shown in FIG. 1, since developing defects are suppressed in the developing device 30, image defects after transfer (for example, irregularities in the image concentration of the toner images TA) are suppressed in comparison with a configuration that includes the supply device of the comparative example mentioned above.

In this instance, as an example, in the image forming apparatus 10, an entire surface halftone image is printed with an image density of 50% by stopping the supply roller 44 after driving the supply roller 44 to rotate for 10 minutes at a peripheral velocity of 40 m/min, and allowing 1 minute to pass after stopping the supply roller 44. As a result of this, irregularities in image concentration could not be seen by eye.

(Second Exemplary Embodiment)

Next, examples of a liquid supply device, a developing device and an image forming apparatus according to a second exemplary embodiment will be described. Additionally, the same symbols as the first exemplary embodiment will be given to the same members and sites as the first exemplary embodiment, and descriptions thereof will be omitted.

Developing Device

Figure 3:
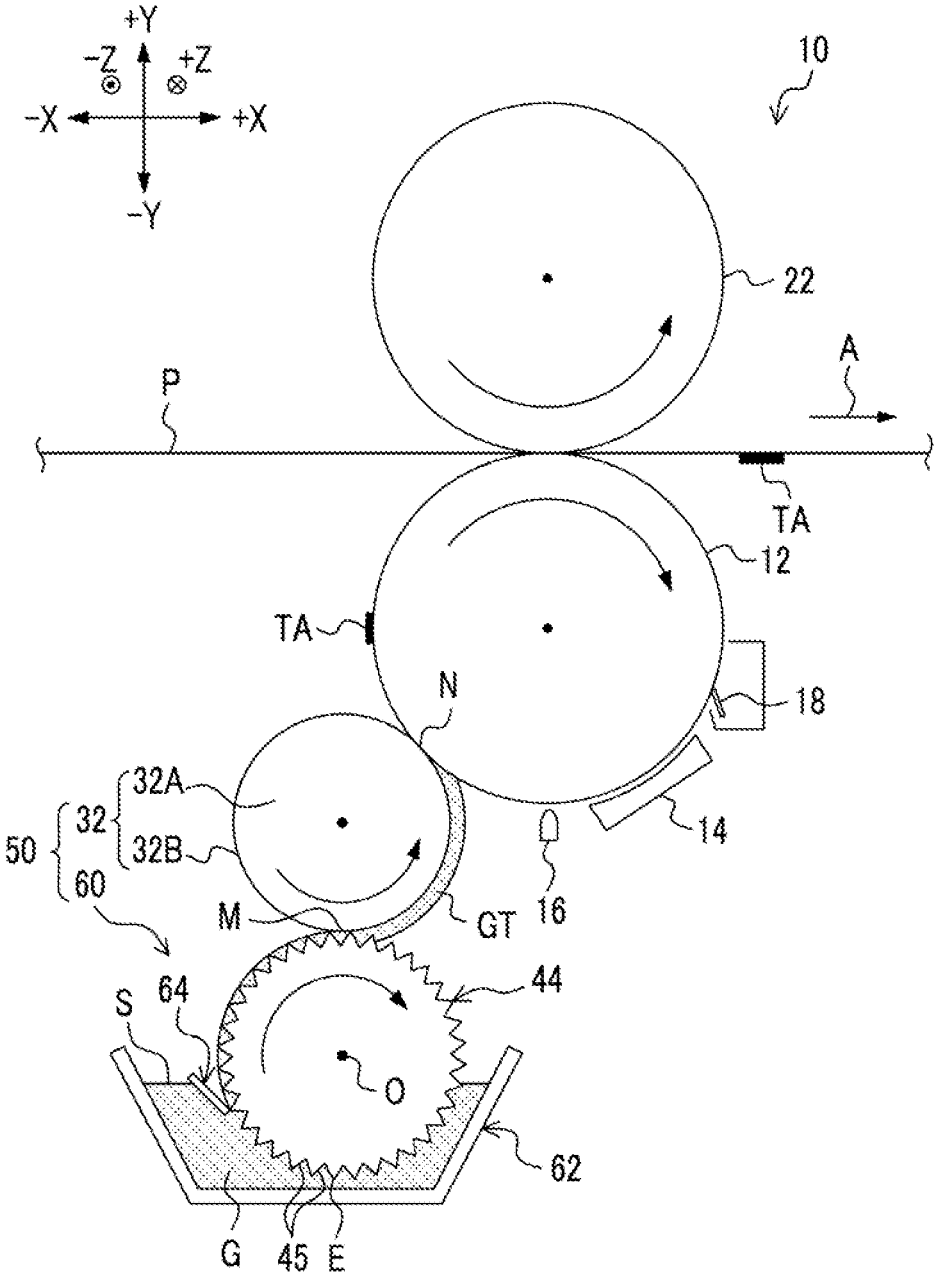
FIG. 3 is an overall configuration diagram of an image forming apparatus according to a second exemplary embodiment.

FIG. 3 shows a developing device 50 according to the second exemplary embodiment. The developing device 50 is provided in place of the developing device 30 (refer to FIG. 1) in the image forming apparatus 10 (refer to FIG. 1). In addition, the developing device 50 includes the developing roller 32, and a supply device 60 as an example of a liquid supply device that supplies the liquid developer G to the developing roller 32.

Supply Device

The supply device 60 that is shown in FIG. 3 includes a reservoir 62 as an example of a reservoir section, the supply roller 44, and a blade 64 as an example of a regulating member.

Reservoir

As an example, the reservoir 62 is formed in a box shape that is long in the Z direction, and open on the +Y side. In addition, the reservoir 62 is disposed on the −Y side of the supply roller 44 in a state in which an open side thereof faces the outer peripheral surface of the supply roller 44. Furthermore, the reservoir 62 is disposed so as to face a site on the outer peripheral surface of the supply roller 44 that, with respect to the rotational center O, moves toward the −Y side and the −X side from the +X side. A supply pipe (not illustrated), which supplies the liquid developer G to the inside of the reservoir 62, is connected to a −Y side end section (a lower end section) of reservoir 62. In addition, a discharge pipe (not illustrated), which discharges the liquid developer G that becomes surplus inside the reservoir 62, is connected to a +Y side end section (an upper end section) of the reservoir 62.

In this instance, the liquid developer G flows into and is stored inside the reservoir 62 as a result of the liquid developer G being fed from the storage tank (not illustrated) into the inside of the supply pipe using a pump. The liquid developer G that becomes surplus inside the reservoir 62 is recovered by a recovery tank (not illustrated) through the discharge pipe. Additionally, a feed-in amount of the liquid developer G to the supply pipe is set to be larger than or equal to a supply amount of the liquid developer G to the supply roller 44. As a result of this, a liquid surface S of the liquid developer G inside the reservoir 62 is retained in a state of being positioned further on a +Y side than an edge portion 64B of the blade 64, which will be described later.

Supply Roller

In the supply roller 44, a lower end portion on the −Y side with respect to the rotational center O is immersed in the liquid developer G of the reservoir 62. Further, as a result of the lower end portion of the supply roller 44 being immersed in the liquid developer G of the reservoir 62 while rotating, the liquid developer G is held on the outer peripheral surface thereof, and therefore, the liquid developer G is supplied to the outer peripheral surface of a developing roller 52.

Blade

Figure 4:
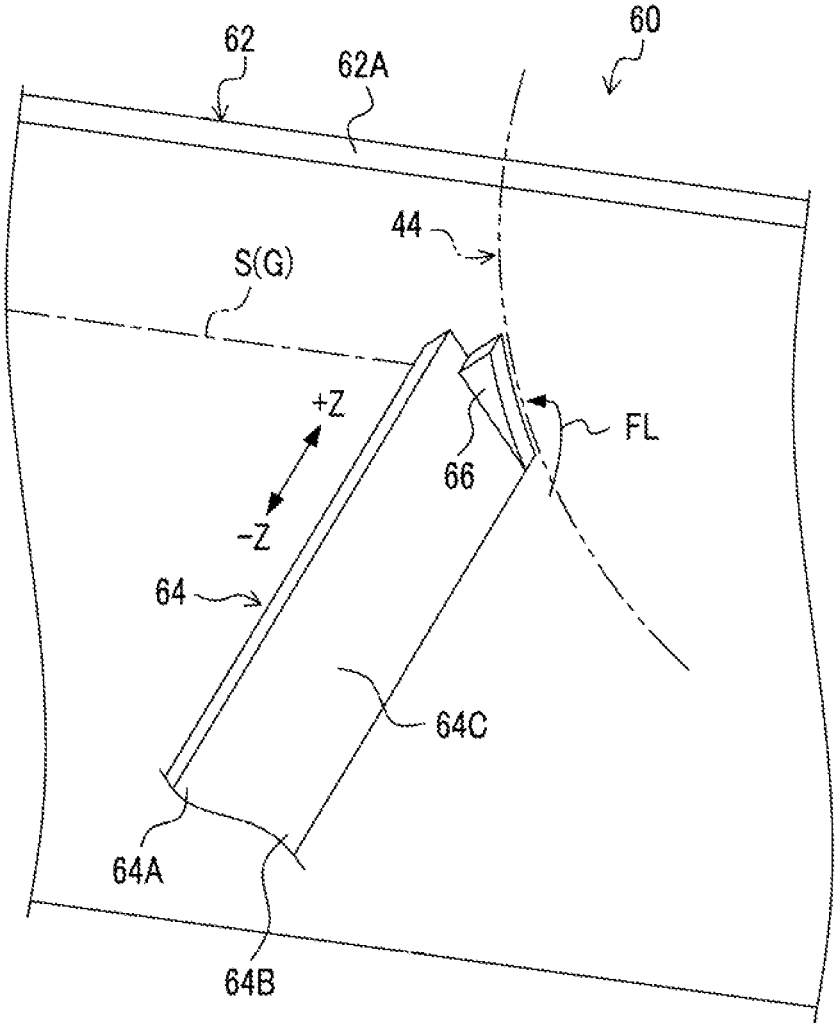
FIG. 4 is an explanatory diagram in which an end section of a blade of a supply device according to the second exemplary embodiment has been enlarged.
Figure 5:
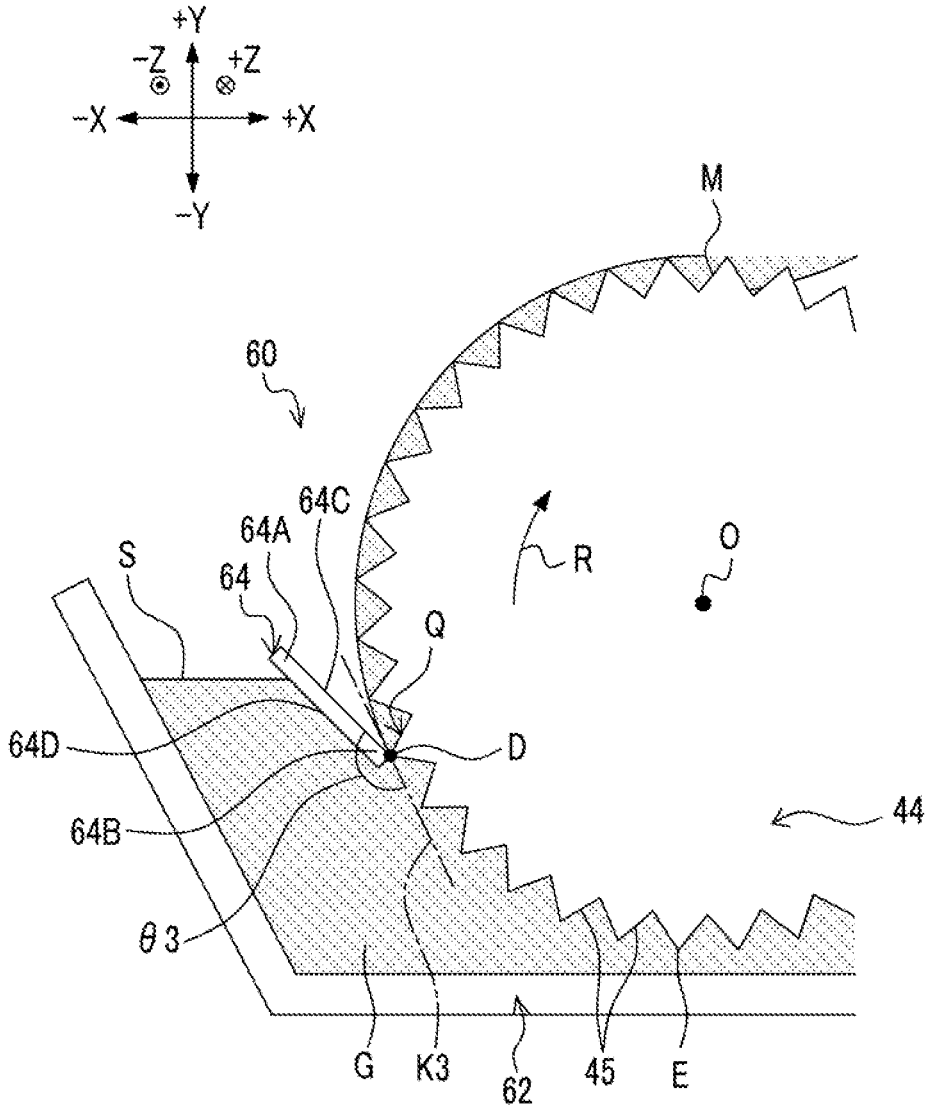
FIG. 5 is an explanatory diagram in which a portion of the supply device according to the second exemplary embodiment has been enlarged.

As an example, the blade 64 that is shown in FIG. 5 is made from stainless steel, and is formed in a plate shape in which the 2 direction is set as a long direction with a thickness of 0.3 mm. In addition, the length in the Z direction of the blade 64 is substantially the same length as the length in the Z direction of the outer peripheral surface of the supply roller 44. A base end section 64A of the −X side of the blade 64 in a short direction is fixed to a blade holder (not illustrated) that is attached to a side wall 62A (refer to FIG. 4) of the reservoir 62. The edge portion 64B of the +X side of the blade 64 in the short direction contacts with the outer peripheral surface of the supply roller 44. As an example, a step-providing treatment is carried out on the edge portion 64B.

A surface of the +Y side of the blade 64 is set as an upper surface 64C, and a surface of a −Y side thereof is set as a lower surface 64D. The upper surface 64C is disposed so that it is difficult for the upper surface 64C to contact with the liquid developer G. Meanwhile, apart from a base end section 64A side, the lower surface 64D contacts with the liquid developer G.

In addition, the blade 64 is disposed inclined along a direction that intersects the Y direction when viewed from the Z direction (at the X-Y plane), and the edge portion 64B is disposed on a +X side and a −Y side with respect to the base end section 64A. Furthermore, a contact position on the X-Y plane between the edge portion 64B and the outer peripheral surface of the supply roller 44 is referred to as a point D. In addition, as a result of the outer peripheral surface of the supply roller 44 resembling a circle, a tangential line of the supply roller 44 at the point D is set as a tangent K3. Among angles that are formed by the tangent K3 and the upper surface 64C, as an example, the blade 64 is disposed inclined so that an angle θ3 of an upstream side in the R direction is 150°. Additionally, as an example, the point D is positioned further on the −Y side than the rotational center O.

In this instance, as a result of the supply amount of the liquid developer G being managed by the pump (not illustrated) mentioned above, the position in the Y direction of a liquid surface S of the liquid developer G that is stored inside the reservoir 62 is further on the +Y side than the edge portion 64B of the blade 64, and is further on the −Y side than the base end section 64A. As an example, the position in the Y direction of the liquid surface S is regulated so as to be 10 mm above the point D in the Y direction.

In this manner, in the blade 64, the edge portion 64B is disposed on a lower side in the Y direction than the liquid surface S, and the lower surface 64D contacts with the liquid developer G. In addition, the blade 64 regulates a holding amount of the liquid developer G of the outer peripheral surf ace of the supply roller 44 as a result of the edge portion 64B contacting with the movement site Q of the outer peripheral surface of the supply roller 44. Additionally, the regulating of the holding amount refers to decreasing a surplus amount, among the liquid developer G held on the outer peripheral surface of the supply roller 44, to a required amount of liquid developer G at the contact section M by scraping the liquid developer G off with using the blade 64.

As shown in FIG. 4, sealing members 66 are attached to the upper surface 64C of end sections in the Z direction of the blade 64. Additionally, the sealing members 66 are respectively attached to both end sections in the Z direction of the blade 64, but since the sealing members 66 have the same configuration, the sealing member 66 on the +Z side is shown in FIG. 4.

As an example, the sealing member 66 made from urethane rubber, and is formed, in a wedge shape in which the width of the edge portion 64B side is narrower than that of the base end section 64A side of the blade 64 when viewed from the Z direction. In addition, the sealing member 66 is disposed between the upper surface 64C of the blade 64 and the supply roller 44 (shown by a dashed-dotted chain line). Further, the sealing member 66 blocks flow (shown by an arrow FL) of the liquid developer G that is wrapping around the upper surface 64C via the end section in Z direction of the blade 64 from end section in the Z direction of the outer peripheral surface of the supply roller 44.

Mechanisms

Next, the mechanisms of the second exemplary embodiment will be described.

In the supply device 60 that is shown in FIG. 5, when the supply roller 44 rotates in the R direction, the edge portion 64B of the blade 64 emits heat due to friction between the blade 64 and the supply roller 44.

In this instance, in the supply device 60, since the edge portion 64B is positioned on a lower side than the liquid surface S, it is difficult for the liquid developer G to fall from the blade 64 and become separated therefrom. That is, in the supply device 60, a contact area between the lower surface 64D of the blade 64 and the liquid developer G is larger than that of the supply device of the comparative example mentioned above. Therefore, since a cooling range of the blade 64 due to the liquid developer G is wider than that of the supply device of the comparative example, rises in temperature of the edge portion 64B are suppressed. As a result of this, a circumstance in which the temperature of the edge portion 64B rises, a portion of the toner T in the liquid developer G melts or becomes softened, and becomes adhered to the cells 45 is suppressed.

In addition, in the supply device 60, the blade 64 contacts with the movement site Q. As a result of this, since the liquid developer G after the holding amount has been regulated, is transported in a state of being held at a site that is on the +Y side of the supply roller 44, it is difficult for the liquid developer G to fall from the supply roller 44, and therefore, in comparison with the supply device of the comparative example, it is unlikely that the inside of the supply device 60 will become stained by the liquid developer G. Furthermore, the installation of equipment such as charging units and surface potential gauges in positions that face the outer peripheral surface of the supply roller 44 after passing through the blade 64 is made easier by the fact that it is difficult for the liquid developer G to fall from the outer peripheral surface of the supply roller 44 after passing through the blade 64.

In the developing device 50 that is shown in FIG. 3, a circumstance in which a portion of the toner T melts or becomes softened and becomes adhered to the cells 45 is suppressed, and therefore, a circumstance in which the holding amount of the liquid developer G that is held on the outer peripheral surface of the supply roller 44 is partially reduced, is suppressed. Therefore, in the developing device 50, a circumstance in which the supply amount of the liquid developer G, which is supplied from the supply roller 44 to the developing roller 32, is reduced, is suppressed in comparison with a configuration that includes the supply device of the comparative example mentioned above. As a result of this, in the developing device 50, developing defects (for example, insufficient amounts of the toner T being transferred to the photosensitive member 12 (refer to FIG. 1)) that are caused by a portion of the liquid developer G becoming adhered to the supply roller 44, are suppressed.

In the image forming apparatus 10 that is shown in FIG. 1, since developing defects are suppressed in the developing device 50, image defects after transfer (for example, irregularities in the image concentration of the toner images TA(refer to FIG. 1)) are suppressed in comparison with a configuration that includes the supply device of the comparative example mentioned above.

In this instance, as an example, in the image forming apparatus 10, an entire surface halftone image is printed with an image density of 50% by stopping the supply roller 44 after driving the supply roller 44 to rotate for 10 minutes at a peripheral velocity of 40 m/min, and allowing 1 minute to pass after stopping the supply roller 44. As a result of this, irregularities in image concentration could not be seen by eye.

Additionally, the present invention is not limited to the above-mentioned exemplary embodiments.

The image forming apparatus 10 is not limited to an image forming apparatus that forms images on sheets of paper P using liquid developer G of one color, and may be an image forming apparatus that forms images on sheets of paper P using liquid developers G of multiple colors. For example, the image forming apparatus 10 may be an image forming apparatus that has a configuration in which multiple developing devices 30 or developing devices 50 are arranged with respect to the photosensitive member 12.

The supply roller 44 is not limited to a supply roller in which multiple cells 45 are formed at the outer peripheral surface thereof, and may be a supply roller in which long carved grooves are formed at the outer peripheral surface in an oblique direction that intersects an axial direction. In addition, the shapes (patterns) of the cells 45 may be pyramid type patterns, lattice type patterns, honeycomb type patterns, or random patterns.

The seal blade 46, the doctor blade 48, and the blade 64 are not limited to being made from a metal such as stainless steel, and may be made from resins. For example, the seal blade 46, the doctor blade 48, and the blade 64 may use blades that are made from urethane. In addition, the cross sectional shapes of the seal blade 46, the doctor blade 48, and the blade 64 are not limited to being rectangular when viewed in the Z direction, and may be shapes in which a portion is curved or bent.

As long as the sealing member 66 is a member that does not absorb the liquid developer G and is elastic, the sealing member 66 is not limited to urethane rubber. For example, the sealing member 66 may use chloroprene rubber, nitrile rubber, polyurethane, silicone rubber or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid supply device comprising:

a reservoir that stores a liquid developer;

a rotating supply member that holds a portion of the liquid developer in the reservoir in concave sections formed in a surface, and supplies the liquid developer to a target supply member; and a doctor blade having an edge portion which is positioned on a lower side in a gravitational direction than a liquid surface of the liquid developer stored in the reservoir, and a lower surface of the doctor blade contacts with the liquid developer in the reservoir, the doctor blade regulating an amount of a liquid developer held on a surface of the rotating supply member by contacting with the rotating supply member at a position where a surface of the rotating supply member moves from a lower side to an upper side in the gravitational direction; and a seal blade having an edge portion which contacts the rotating supply member at a position lower, in the gravitational direction, than the position at which the edge portion of the doctor blade contacts the rotating supply member, and an upper surface of the seal blade contacts with the liquid developer in the reservoir, wherein an angle of incline of the seal blade is less than an angle of incline of the doctor blade.

2. The liquid supply device according to claim 1, wherein the doctor blade is a plate-shaped scraping member.

3. The liquid supply device according to claim 1, wherein the edge portion of the doctor blade is lower than the liquid surface of the liquid developer by 5 mm or more.

4. A developing device comprising:

the liquid supply device according to claim 1; and a developing rotating member as the target supply member that rotates, and develops using a liquid developer supplied from the rotating supply member by contacting with an outer peripheral surface of the rotating supply member.

5. The developing device according to claim 4, wherein the doctor blade of the liquid supply device is a plate-shaped scraping member.

6. The developing device according to claim 4, wherein the edge of the doctor blade of the liquid supply device is lower than a liquid surface of the liquid developer by 5 mm or more.

7. An image forming apparatus comprising:

an image holding member on which an electrostatic latent image is formed;

the developing device according to claim 4 that develops the latent image with a liquid developer; and a transfer unit that transfers a developer image developed by the developing device to a target transfer member.

8. The image forming apparatus according to claim 7, wherein the doctor blade of the liquid supply device is a plate-shaped scraping member.

9. The image forming apparatus according to claim 7, wherein an edge portion of the doctor blade of the liquid supply device lower than a liquid surface of the liquid developer by 5 mm or more.

* * * * *